US010780013B1

(12) United States Patent
Feld

(10) Patent No.: US 10,780,013 B1
(45) Date of Patent: Sep. 22, 2020

(54) ASSISTIVE CANE AND REACH EXTENSION COMBINATION DEVICE

(71) Applicant: Arnold Feld, Hockley, TX (US)

(72) Inventor: Arnold Feld, Hockley, TX (US)

( * ) Notice: Subject to any disclaimer, the term of this patent is extended or adjusted under 35 U.S.C. 154(b) by 0 days.

(21) Appl. No.: 16/545,954

(22) Filed: Aug. 20, 2019

(51) Int. Cl.
*A45B 3/00* (2006.01)
*A61H 3/02* (2006.01)
*E01H 1/12* (2006.01)

(52) U.S. Cl.
CPC ..... *A61H 3/0288* (2013.01); *A45B 3/00* (2013.01); *E01H 1/12* (2013.01); *A61H 2003/0205* (2013.01); *A61H 2003/0222* (2013.01); *A61H 2003/0283* (2013.01); *E01H 2001/1293* (2013.01)

(58) Field of Classification Search
CPC .... A61H 3/00; A61H 3/02; A61H 2003/0222; A61H 2003/0205; A45B 3/00; E01H 2001/1293; E01H 1/12; E01H 1/1206
USPC ..... 135/65–66, 69, 76, 84; 294/1.4, 16, 294/101–106, 115, 192
See application file for complete search history.

(56) References Cited

U.S. PATENT DOCUMENTS 465,222 A * 12/1891 Ulbricht ..... B66C 1/48 294/104
1,905,076 A 4/1933 Van Sciver
2,836,188 A * 5/1958 Jordan ..... A45B 3/00 135/66
4,037,868 A * 7/1977 Baker ..... E01H 1/12 294/104
4,200,322 A * 4/1980 Smith ..... B25J 1/04 294/104
4,930,825 A * 6/1990 Dearman ..... A01B 1/18 172/378
5,176,160 A 1/1993 Osborn
5,192,104 A * 3/1993 Lin ..... B25J 1/04 294/104
5,433,234 A * 7/1995 Lapere ..... A45B 3/00 135/66
5,640,985 A 6/1997 Snyder
6,550,490 B1 4/2003 Morton
6,651,684 B2 * 11/2003 Spitzer ..... A45B 1/00 135/77
6,951,224 B2 * 10/2005 Garrett ..... A45B 3/00 135/66
7,243,668 B1 7/2007 Kroeze
(Continued)

FOREIGN PATENT DOCUMENTS

EP 2338374 12/2011

*Primary Examiner* — Noah Chandler Hawk

(57) ABSTRACT

An assistive cane and reach extension combination device for improved stability and reach includes a shaft. A handle that is coupled to and extends from of the shaft is configured to be grasped in a hand of a user, positioning the shaft to transfer a load from the handle to a surface upon which the user is positioned. A bar that is hingedly coupled to the shaft proximate to the handle is selectively positionable in a stowed configuration, wherein the bar is substantially parallel to the shaft, and a deployed configuration, wherein the bar is selectively positionable transversely to the shaft. In the deployed configuration the bar and the shaft are configured to insert an article. An actuator that is coupled to the shaft is operationally coupled to the bar so that the actuator is positioned to selectively motivate the bar toward the shaft to grasp the article.

18 Claims, 4 Drawing Sheets

(56) References Cited

U.S. PATENT DOCUMENTS

| | | | | |
|---|---|---|---|---|
| 9,132,544 | B2 * | 9/2015 | Levkus | B25J 1/04 |
| 9,277,794 | B2 | 3/2016 | Moreau | |
| 9,370,226 | B2 | 6/2016 | Dole | |
| 2008/0149155 | A1 | 6/2008 | Martin | |
| 2009/0032077 | A1 | 2/2009 | Hines | |
| 2012/0060878 | A1 * | 3/2012 | Thiessens | A45B 1/04 135/66 |
| 2015/0151429 | A1 * | 6/2015 | Thibodeaux | B25J 1/04 294/104 |

* cited by examiner

ASSISTIVE CANE AND REACH EXTENSION COMBINATION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to mobility aids and more particularly pertains to a new mobility aid for improved stability and reach.

(2) Description of Related Art Including Information Disclosed Under 37 CFR 1.97 and 1.98

The prior art relates to mobility aids.

BRIEF SUMMARY OF THE INVENTION

An embodiment of the disclosure meets the needs presented above by generally comprising a shaft. A handle that is coupled to and extends from an upper end of the shaft is configured to be grasped in a hand of a user, positioning the shaft to transfer a load from the handle to a surface upon which the user is positioned. A bar that is hingedly coupled to the shaft proximate to the handle is selectively positionable in a stowed configuration, wherein the bar is substantially parallel to the shaft, and a deployed configuration, wherein the bar is selectively positionable transversely to the shaft. In the deployed configuration the bar and the shaft are configured to insert an article. An actuator that is coupled to the shaft is operationally coupled to the bar so that the actuator is positioned to selectively motivate the bar toward the shaft to grasp the article.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
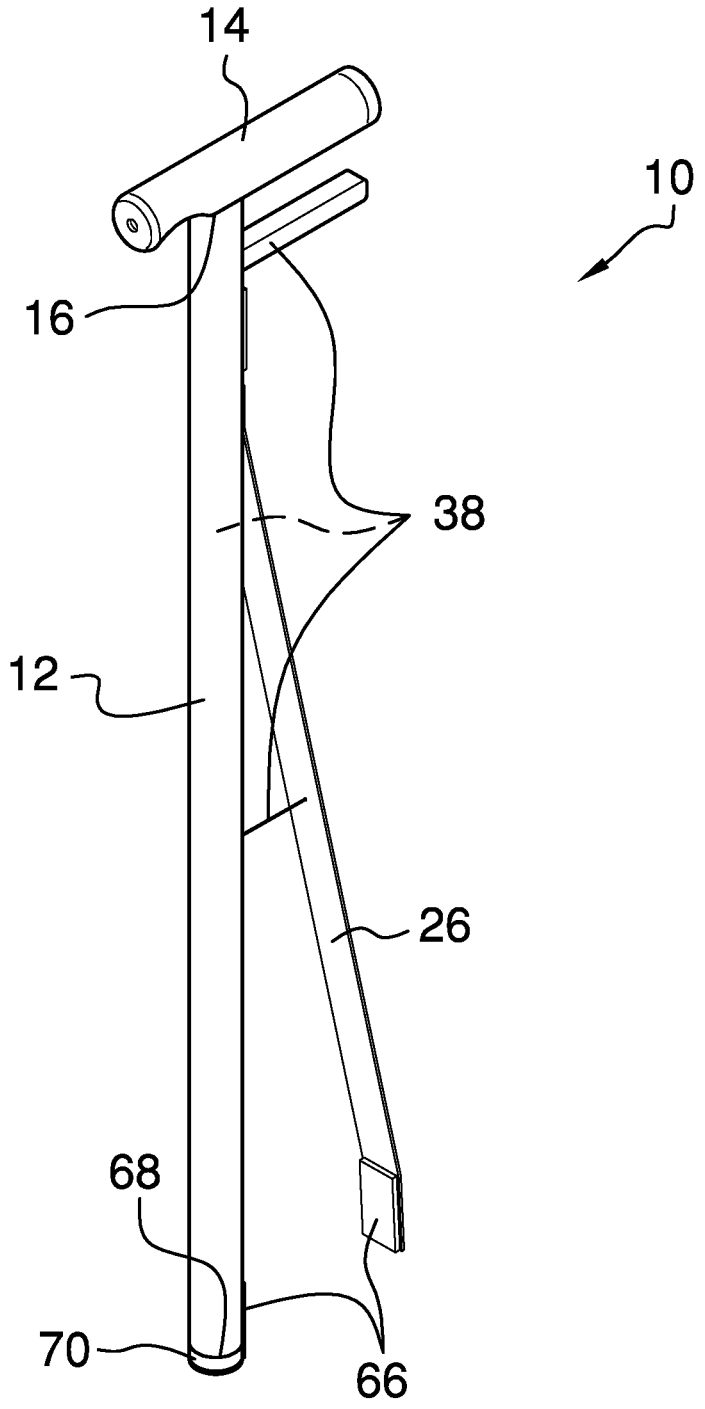
FIG. 1 is an isometric perspective view of an assistive cane and reach extension combination device according to an embodiment of the disclosure.

With reference now to the drawings, and in particular to FIGS. 1 through 6 thereof, a new mobility aids embodying the principles and concepts of an embodiment of the disclosure and generally designated by the reference numeral 10 will be described.

As best illustrated in FIGS. 1 through 6, the assistive cane and reach extension combination device 10 generally comprises a shaft 12 that is hollow. The shaft 12 is at least one of circularly shaped and squarely shaped when viewed longitudinally. A handle 14 is coupled to and extends from an upper end 16 of the shaft 12. The handle 14 is configured to be grasped in a hand of a user, positioning the shaft 12 to transfer a load from the handle 14 to a surface upon which the user is positioned. The handle 14 extends perpendicularly and bidirectionally from the shaft 12 to define a forward section 18 and a rearward section 20 of the handle 14.

A cutout 22 extends into a lower face 24 of the handle 14 in the forward section 18. The cutout 22 is configured to insert a digit of the hand of the user that is grasping the handle 14 to enhance a grasp of the hand upon the handle 14.

A bar 26 that is hingedly coupled to the shaft 12 proximate to the handle 14 is selectively positionable in a stowed configuration, wherein the bar 26 is substantially parallel to the shaft 12, and a deployed configuration, wherein the bar 26 is selectively positionable transversely to the shaft 12. In the deployed configuration, the bar 26 and the shaft 12 are configured to insert an article.

Figure 3:
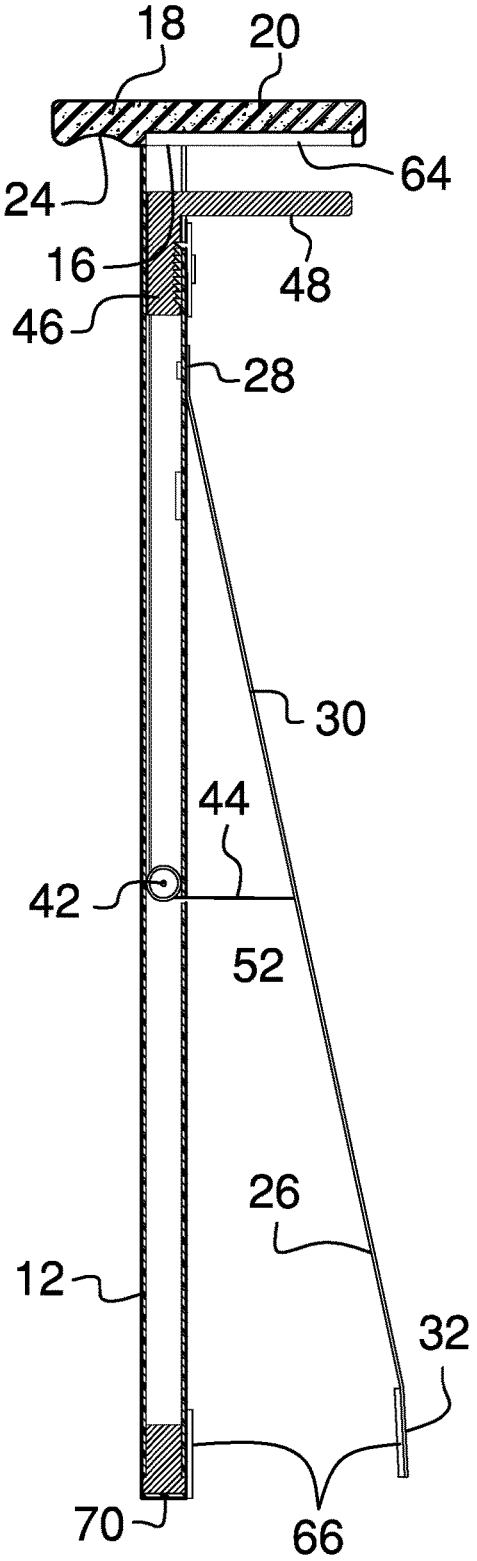
FIG. 3 is a cross-sectional view of an embodiment of the disclosure.

The bar 26 comprises a first segment 28, a second segment 30, and a third segment 32, as shown in FIG. 3. The first segment 28 is flush to and is coupled to the shaft 12. The second segment 30 is coupled to and extends transversely from the first segment 28. The third segment 32 is coupled to and extends transversely from the second segment 30 distal from the first segment 28 so that the third segment 32 is substantially parallel to the shaft 12 when the bar 26 is in the deployed configuration.

Figure 2:
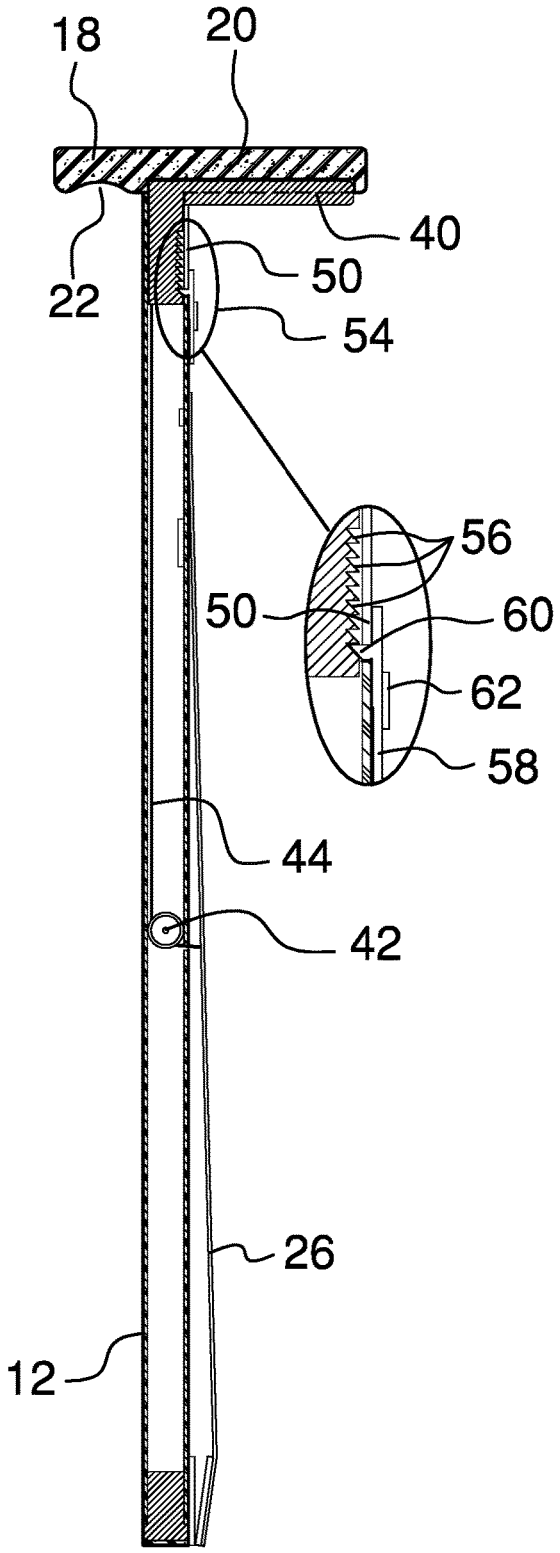
FIG. 2 is a cross-sectional view of an embodiment of the disclosure.
Figure 4:
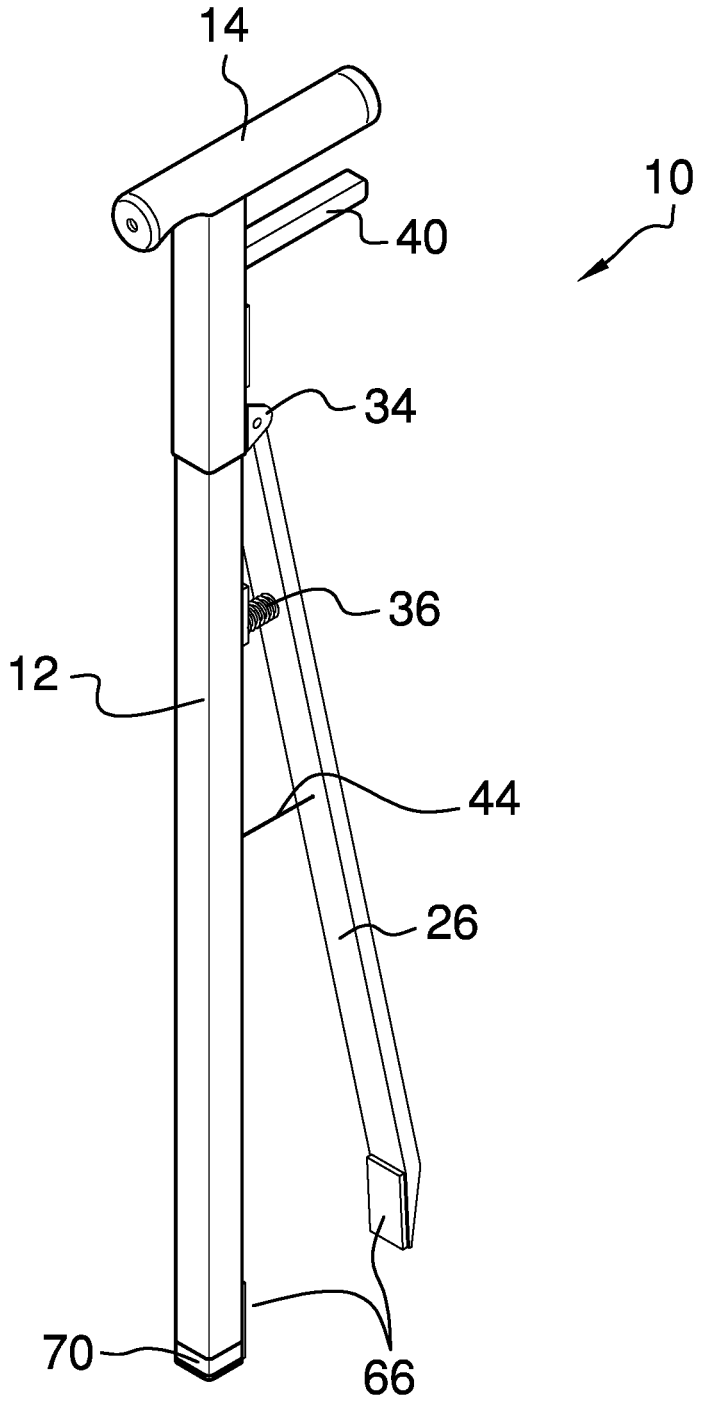
FIG. 4 is an isometric perspective view of an alternative embodiment of the disclosure.
Figure 5:
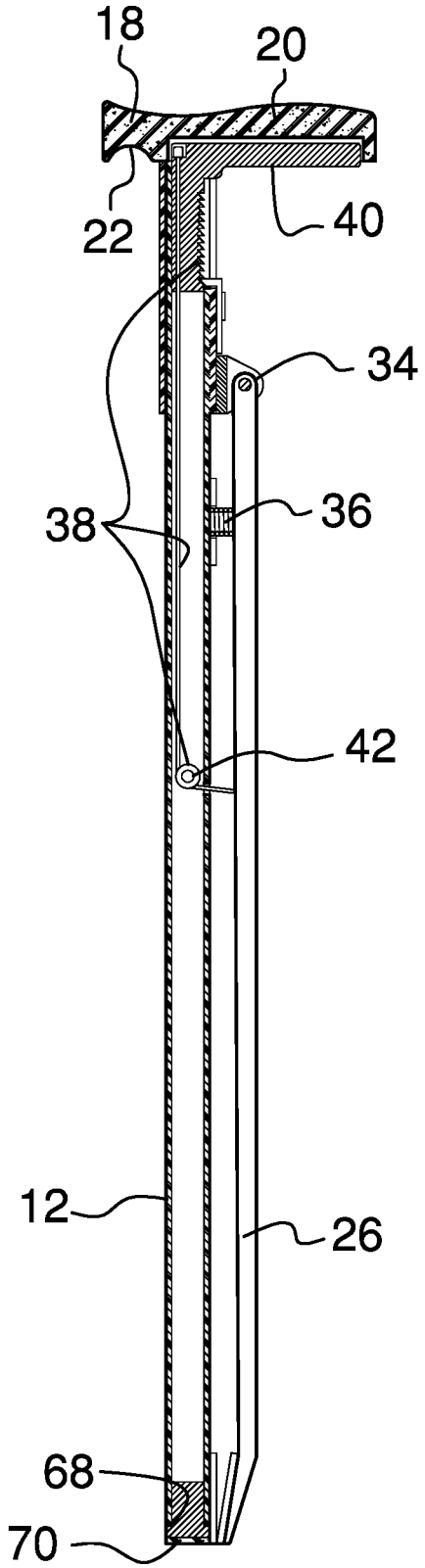
FIG. 5 is a cross-sectional view of an alternative embodiment of the disclosure.
Figure 6:
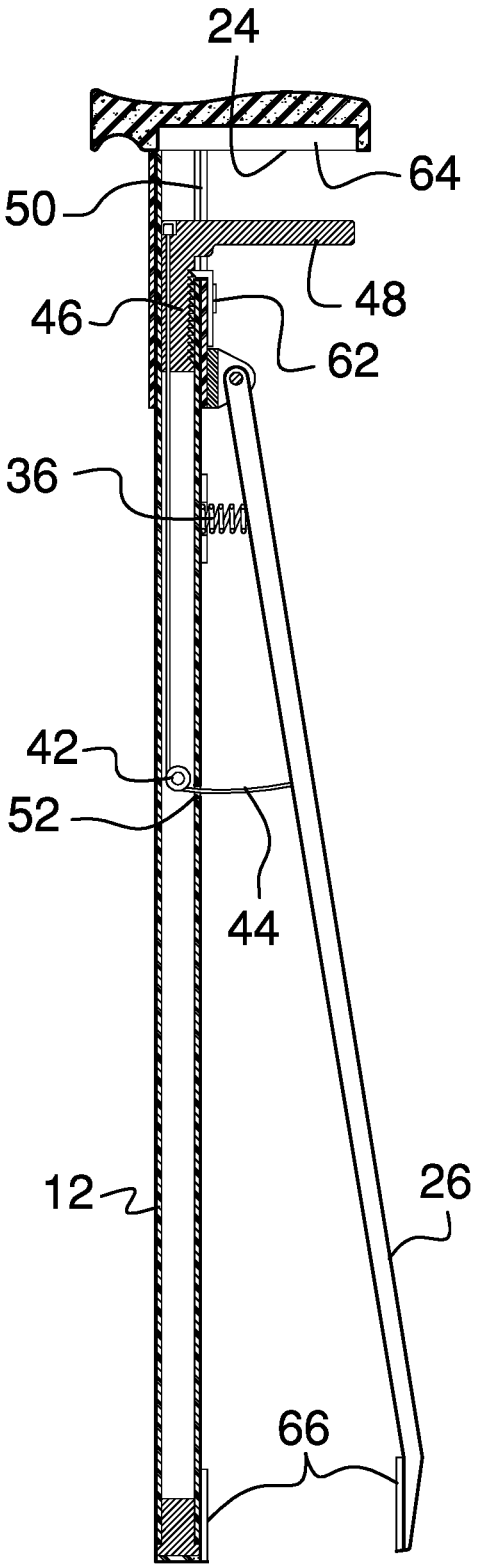
FIG. 6 is a cross-sectional view of an alternative embodiment of the disclosure.

In one embodiment, as shown in FIGS. 1-3, the bar 26 comprises spring steel so that the bar 26 is tensioned in the stowed configuration. In another embodiment, as shown in FIGS. 4-6, a hinge 34 is coupled to the shaft 12 and the bar 26 is coupled to the hinge 34. A coiled spring 36 is coupled to and extends between the shaft 12 and the bar 26 so that the coiled spring 36 is tensioned when the bar 26 is in the stowed configuration and thus positioned to rebound to extend the bar 26 to the deployed configuration.

An actuator 38 that is coupled to the shaft 12 is operationally coupled to the bar 26 so that the actuator 38 is positioned to selectively motivate the bar 26 toward the shaft 12 to grasp the article.

The actuator 38 comprises a trigger 40, a pulley 42, and a cable 44, as shown in FIGS. 2, 3, 5, and 6. The trigger 40 comprises a first section 46, which is slidably positioned in the shaft 12, and a second section 48 that extends perpendicularly from the first section 46 through a slot 50 in the shaft 12 so that the second section 48 is proximate to the handle 14. The pulley 42 is coupled to and is positioned in the shaft 12 proximate to a hole 52 that is positioned in the shaft 12. The cable 44 is coupled to and extends between the first section 46 of the trigger 40 and the bar 26. The cable 44 is positioned around the pulley 42 and through the hole 52 so that the cable 44 is positioned to motivate the bar 26 toward the shaft 12 as the trigger 40 is motivated toward the handle 14.

A locking means 54 that is coupled to the shaft 12 is operationally coupled to the trigger 40 so that the locking means 54 is positioned to selectively fix the bar 26 in the stowed configuration, and also selectively in positions between the stowed configuration and the deployed configuration.

The locking means 54 may comprise a plurality of notches 56 that is positioned in the first section 46 of the trigger 40, as shown in FIG. 2. A plate 58 is coupled to the shaft 12 proximate to the slot 50. A tooth 60 is coupled to and extends from the plate 58 into the slot 50 so that the tooth 60 is selectively positionable in a respective notch 56 to fixedly position the bar 26 relative to the shaft 12. A button 62, which is depressible and operationally coupled to the tooth 60, is configured to be selectively depressed to extract the tooth 60 from the respective notch 56 so that the bar 26 is hingable relative to the shaft 12. The locking means 54 may comprise other means of selectively fixing the bar 26 relative to the shaft 12, such as, but not limited to, a spring-loaded pin and holes in the first section 46 of the trigger 40, sleeves around the shaft 12, and the like.

A recess 64 extends into the lower face 24 of the handle 14 in the rearward section 20 so that the second section 48 of the trigger 40 is at least partially nested in the recess 64 when the bar 26 is in the stowed configuration.

A pair of pads 66 is coupled singly to the shaft 12 proximate to a lower end 68 of the shaft 12 and to the bar 26 distal from the shaft 12 so that the pads 66 are in substantial abutment when the bar 26 is in the stowed configuration. The pads 66 are resiliently compressible and are configured to enhance a grasp of the shaft 12 and the bar 26 upon the article. The pads 66 comprise at least one of rubber, silicone, and elastomer.

A ferrule 70 is coupled to the lower end 68 of the shaft 12. The ferrule 70 is resiliently compressible and is configured to enhance traction of the shaft 12 on the surface. The ferrule 70 comprises at least one of rubber, silicone, and elastomer.

In use, the device 10 is utilized by the user as an assistive cane. When extended reach is required, the user is positioned to push the button 62 so that the bar 26 extends to the deployed configuration. The user then positions the article between the shaft 12 and the bar 26 and pulls the trigger 40 toward the handle 14 to grasp the article. The user releases the button 62 when the article is grasped between the shaft 12 and the bar 26 and pushes the button 62 again to release the article.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. An assistive cane and reach extension combination device comprising:

a shaft, the shaft being hollow;

a handle coupled to and extending from an upper end of the shaft wherein the handle is configured for grasping in a hand of a user positioning the shaft for transferring a load from the handle to a surface upon which the user is positioned;

a bar hingedly coupled to the shaft proximate to the handle such that the bar is selectively positionable in a stowed configuration wherein the bar is substantially parallel to the shaft and a deployed configuration wherein the bar is selectively positionable transversely to the shaft wherein the bar and the shaft are configured for inserting an article; and an actuator coupled to the shaft, the actuator being operationally coupled to the bar such that the actuator is positioned for selectively motivating the bar toward the shaft for grasping the article, the actuator comprising a trigger comprising a first section and a second section, the first section being slidably positioned in the shaft, the second section extending perpendicularly from the first section through a slot in the shaft such that the second section is proximate to the handle, a pulley coupled to and positioned in the shaft, a hole positioned in the shaft proximate to the pulley, and a cable coupled to and extending between the first section of the trigger and the bar, the cable being positioned around the pulley and through the hole such that the cable is positioned for motivating the bar toward the shaft as the trigger is motivated toward the handle.

2. The device of claim 1, further including the shaft being at least one of circularly shaped and squarely shaped when viewed longitudinally.

3. The device of claim 1, further including the handle extending perpendicularly from the shaft.

4. The device of claim 3, further including the handle extending bidirectionally from the shaft defining a forward section and a rearward section of the handle.

5. The device of claim 4, further including a cutout extending into a lower face of the handle in the forward section wherein the cutout is configured for inserting a digit of the hand of the user grasping the handle for enhancing a grasp of the hand upon the handle.

6. The device of claim 1, further including the bar comprising a first segment, a second segment, and a third segment, the first segment being flush to and coupled to the shaft, the second segment being coupled to and extending transversely from the first segment, the third segment being coupled to and extending transversely from the second segment distal from the first segment such that the third segment is substantially parallel to the shaft when the bar is in the deployed configuration.

7. The device of claim 6, further including the bar comprising spring steel such that the bar is tensioned in the stowed configuration.

8. The device of claim 1, further including a locking means coupled to the shaft, the locking means being operationally coupled to the trigger such that the locking means is positioned for selectively fixing the bar in the stowed configuration and selectively in positions between the stowed configuration and the deployed configuration.

9. The device of claim 8, further including the locking means comprising:

a plurality of notches positioned in the first section of the trigger;

a plate coupled to the shaft proximate to the slot;

a tooth coupled to and extending from the plate into the slot such that the tooth is selectively positionable in a respective notch for fixedly positioning the bar relative to the shaft; and a button coupled to the plate, the button being depressible, the button being operationally coupled to the tooth such that the button is configured for selectively depressing for extracting the tooth from the respective notch such that the bar is hingable relative to the shaft.

10. The device of claim 1, further including a recess extending into a lower face of the handle in a rearward section of the handle such that the second section of the trigger is at least partially nested in the recess when the bar is in the stowed configuration.

11. The device of claim 1, further including a pair of pads coupled singly to the shaft proximate to a lower end of the shaft and to the bar distal from the shaft such that the pads are in substantial abutment when the bar is in the stowed configuration, the pads being resiliently compressible wherein the pads are configured for enhancing a grasp of the shaft and the bar upon the article.

12. The device of claim 11, further including the pads comprising at least one of rubber, silicone, and elastomer.

13. The device of claim 1, further including a ferrule coupled to a lower end of the shaft, the ferrule being resiliently compressible wherein the ferrule is configured for enhancing traction of the shaft on the surface.

14. The device of claim 13, further including the ferrule comprising at least one of rubber, silicone, and elastomer.

15. The device of claim 1, further comprising:

a hinge coupled to the shaft, the bar being coupled to the hinge; and a coiled spring coupled to and extending between the shaft and the bar such that the coiled spring is tensioned when the bar is in the stowed configuration and positioned for rebounding for extending the bar to the deployed configuration.

16. An assistive cane and reach extension combination device comprising:

a shaft, the shaft being hollow, the shaft being at least one of circularly shaped and squarely shaped when viewed longitudinally;

a handle coupled to and extending from an upper end of the shaft wherein the handle is configured for grasping in a hand of a user positioning the shaft for transferring a load from the handle to a surface upon which the user is positioned, the handle extending perpendicularly from the shaft, the handle extending bidirectionally from the shaft defining a forward section and a rearward section of the handle;

a cutout extending into a lower face of the handle in the forward section wherein the cutout is configured for inserting a digit of the hand of the user grasping the handle for enhancing a grasp of the hand upon the handle;

a bar hingedly coupled to the shaft proximate to the handle such that the bar is selectively positionable in a stowed configuration wherein the bar is substantially parallel to the shaft and a deployed configuration wherein the bar is selectively positionable transversely to the shaft wherein the bar and the shaft are configured for inserting an article, the bar comprising a first segment, a second segment, and a third segment, the first segment being flush to and coupled to the shaft, the second segment being coupled to and extending transversely from the first segment, the third segment being coupled to and extending transversely from the second segment distal from the first segment such that the third segment is substantially parallel to the shaft when the bar is in the deployed configuration;

an actuator coupled to the shaft, the actuator being operationally coupled to the bar such that the actuator is positioned for selectively motivating the bar toward the shaft for grasping the article, the actuator comprising:

a trigger comprising a first section and a second section, the first section being slidably positioned in the shaft, the second section extending perpendicularly from the first section through a slot in the shaft such that the second section is proximate to the handle, a pulley coupled to and positioned in the shaft, a hole positioned in the shaft proximate to the pulley, and a cable coupled to and extending between the first section of the trigger and the bar, the cable being positioned around the pulley and through the hole such that the cable is positioned for motivating the bar toward the shaft as the trigger is motivated toward the handle;

a locking means coupled to the shaft, the locking means being operationally coupled to the trigger such that the locking means is positioned for selectively fixing the bar in the stowed configuration and selectively in positions between the stowed configuration and the deployed configuration, the locking means comprising:

a plurality of notches positioned in the first section of the trigger, a plate coupled to the shaft proximate to the slot, a tooth coupled to and extending from the plate into the slot such that the tooth is selectively positionable in a respective notch for fixedly positioning the bar relative to the shaft, and a button coupled to the plate, the button being depressible, the button being operationally coupled to the tooth such that the button is configured for selectively depressing for extracting the tooth from the respective notch such that the bar is hingable relative to the shaft;

a recess extending into the lower face of the handle in the rearward section such that the second section of the trigger is at least partially nested in the recess when the bar is in the stowed configuration;

a pair of pads coupled singly to the shaft proximate to the lower end of the shaft and to the bar distal from the shaft such that the pads are in substantial abutment when the bar is in the stowed configuration, the pads being resiliently compressible wherein the pads are configured for enhancing a grasp of the shaft and the bar upon the article, the pads comprising at least one of rubber, silicone, and elastomer; and a ferrule coupled to the lower end of the shaft, the ferrule being resiliently compressible wherein the ferrule is configured for enhancing traction of the shaft on the surface, the ferrule comprising at least one of rubber, silicone, and elastomer.

17. The device of claim 16, further including the bar comprising spring steel such that the bar is tensioned in the stowed configuration.

18. The device of claim 16, further comprising:

a hinge coupled to the shaft, the bar being coupled to the hinge; and a coiled spring coupled to and extending between the shaft and the bar such that the coiled spring is tensioned when the bar is in the stowed configuration and positioned for rebounding for extending the bar to the deployed configuration.

* * * * *